US005768787A

United States Patent [19]

Ireland

[11] Patent Number: 5,768,787

[45] Date of Patent: Jun. 23, 1998

[54] KNIVES WITH SLOTS

[76] Inventor: William Alfred Ireland, 257 Pirton Lane, Churchdown, Gloucestershire, England

[21] Appl. No.: 743,218

[22] Filed: Nov. 5, 1996

[30] Foreign Application Priority Data

Nov. 7, 1995 [GB] United Kingdom ..... 9522738

[51] Int. Cl.[6] ..... B26B 29/06

[52] U.S. Cl. ..... 30/294; 30/335

[58] Field of Search ..... 30/293, 294, 162, 30/2, 335, 336

[56] References Cited

U.S. PATENT DOCUMENTS 2,593,601 4/1952 Pollak ..... 30/294 X

FOREIGN PATENT DOCUMENTS 1 524 799 9/1978 United Kingdom .

2 216 835 10/1989 United Kingdom .

2 295 136 5/1996 United Kingdom .

*Primary Examiner*—Douglas D. Watts

*Attorney, Agent, or Firm*—Young & Thompson

[57] ABSTRACT

A safety knife comprises a main body formed with a slot having a narrow open mouth, into which the material to be cut is inserted, and a blade mounted on the main body with a portion of its cutting edge extending across the slot at a location spaced inwardly from the mouth of the slot. The blade is mounted in a recess in the main body for sliding movement across the slot, against the action of a spring, and is coupled to a sleeve which is slidable on the main body. The user holds the knife by the sleeve so that, as the knife is used to cut material, the relative movement between the sleeve and main body causes to blade to slide across the slot, thus enhancing the cutting action.

17 Claims, 2 Drawing Sheets

KNIVES WITH SLOTS

BACKGROUND OF THE INVENTION

The invention relates to knives and particularly to safety knives of the kind comprising a main body formed with a slot and a blade mounted on the main body with a portion of the cutting edge of the blade extending across the slot at a location spaced inwardly from the mouth of the slot. One form of safety knife of this basic kind is described and claimed in British Patent No. 2216835.

With such a knife sheet materials, tapes, string and the like may be cut by introducing the material into the slot and pushing or pulling the knife across it so that the material is forced against the blade. Since the blade is protected within the slot the knife is available for use at all times and does not have to be opened first, as with a conventional folding knife, and there is virtually no risk of the user being accidentally cut by the blade as is the case with a folding knife or sheath knife.

In knives of this kind only a comparatively short length of the cutting edge of the blade is exposed across the slot. As a result of this, if the small exposed portion of the cutting edge becomes damaged or blunted, it is necessary to replace the blade. If the blade cannot be replaced the knife becomes useless. Also, although some materials can be cut simply by transverse movement across the cutting edge of the blade, in most cases the cuting action is enhanced by a degree of sliding movement of the material along the cutting edge. However, in conventional safety knives having a protective blade, the length of the exposed cutting edge is comparatively small so that the permitted movement of the material along the cutting edge is limited.

In some knives of this type, particularly of the kind where the knife is intended to be drawn towards the user, there is an acute angle between the cutting edge of the blade and the adjacent side of the slot. In this case there may be a tendency for the material being cut to become wedged tightly into this acute angle, thus inhibiting an effective cutting action.

The present invention sets out to provide an improved design of safety knife where some or all of the above disadvantages of existing designs may be overcome.

SUMMARY OF THE INVENTION

According to the invention there is provided a knife comprising a main body formed with a slot having a narrow open mouth and a blade mounted on the main body with a portion of the cutting edge of the blade extending across the slot at a location spaced inwardly from the mouth of the slot, said blade being mounted on the main body for movement relative thereto across the slot, means being provided for effecting said movement of the blade.

Since the blade is movable, different portions ofthe cutting edge may be exposed across the slot, thus prolonging the life of the blade. Also, if the movement is effected during a cutting action by the knife, the relative movement between the blade and the main body will cause a greater extent of relative longitudinal movement between the blade and the material being cut, thus enhancing the cutting effect.

Preferably the blade is enclosed within the main body save for the portion thereof which extends across the slot.

The means for effecting movement of the blade may comprise a manipulating member movably mounted on the main body and coupled to the blade so that movement of the manipulating member relative to the main body causes movement of the blade across the slot. Preferably the manipulating member is mounted on the main body for sliding movement relative thereto in a direction substantially parallel to the cutting edge of the blade. In this case the blade may be directly coupled to the manipulating member so that the blade moves in the same diction as the manipulating member. Alternatively, by connecting the manipulating member to the blade through a suitable linkage, for example a pivoted linkage, the blade may be arranged to move in any other desired direction relative to the direction of movement of the manipulating member. The manipulating member may comprise a collar or sleeve surrounding an elongate portion of the main body The manipulating member may constitute a handle by which the knife may be held in use, whereby restraint to movement of the main body causes the manipulating member to move relative to the main body, thus effecting the movement of the blade across the slot automatically. Stop means may be provided to limit the movement of the manipulating member relative to the main body.

In any of the above arrangements spring means may be provided to urge the blade to a datum position.

The blade may be slidable along an elongate recess in the main body, the spring means, which may be a compression spring or a tension spring, being connected between one end of the blade and a fixed part of the main body. For example, the spring means may be located in a cavity forming an extension of said recess. The cavity containing the spring means may be at least partly open to one or both longitudinal sides of the main body so that the spring means may be inserted laterally into the cavity.

In an alternative arrangement the spring means may be connected between the manipulating member and the main body.

The recess in which the blade is slidable preferably extends from an opening at the surface of the main body so that the blade may be inserted into the recess, or removed therefrom, through said opening. In this case the blade may be movable to a position where a small portion thereof projects from said opening in the external surface of the main body. The projecting portion, which is preferably unsharpened, may then be used for jobs such as slitting paper or plastics packaging or sealing tapes. Alternatively a separate projecting portion, for slitting, may be fixedly provided on the main body itself.

In one embodiment of the invention, one side of the slot in the main body is defined by a longitudinal surface of a tapered tip portion of the main body, the exposed portion of the cutting edge of the blade extending at an obtuse angle to said longitudinal surface of the tapered tip portion. In use, the tapered tip portion may be introduced below the material to be cut so that the material slides up the longitudinal surface thereof and then directly on to the exposed cutting edge of the blade.

In an alternative embodiment, the exposed portion of the cutting edge of the blade may extend at an acute angle to the longitudinal surface of the tapered tip portion. In this case the material to be cut slides up the surface of the tapered tip portion and enters the acute angle between the blade and that surface with a wedging action, leading to the severing of the material.

In any of the above arrangements the side of the slot forming an acute angle with the cutting edge of the blade may be formed with a longitudinal groove or gap into which the cutting edge of the blade partly extends. In use the material to be cut becomes partly forced into the groove or gap causing it to be bent over the cutting edge of the blade, which is found to enhance the cutting action. One form of construction of such groove or gap is described in the above-mentioned British Patent No. 2216835.

DETAILED DESCRIPTION OF THE PREFERRED EMBODIMENTS

Figure 1:
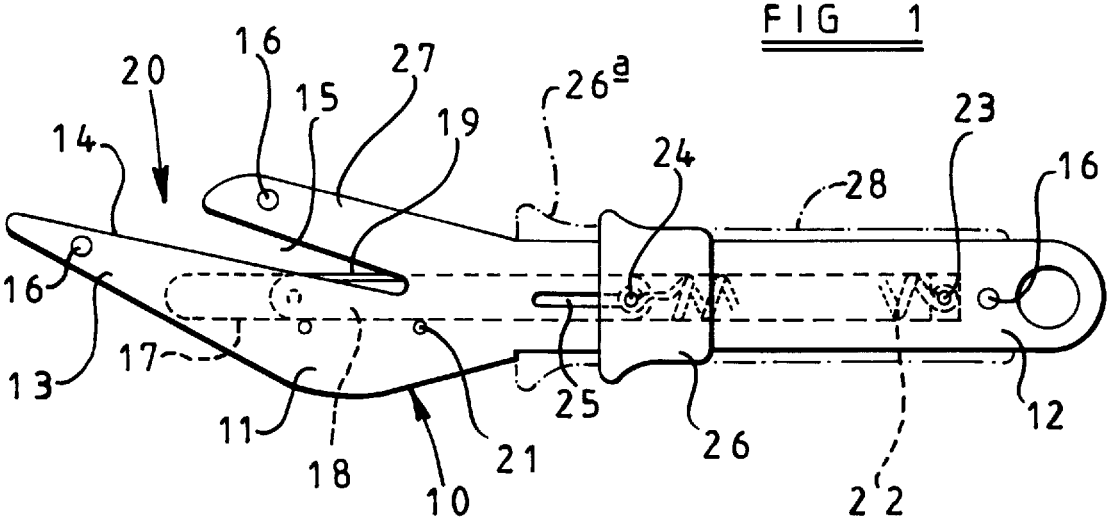
FIG. 1 is a diagrammatic side view of a safety knife in accordance with the invention.

Referring to FIG. 1, there is shown a safety knife comprising a main body 10 providing a head 11 and an elongate handle 12. The head 11 is formed with a tapered tip portion 13, one longitudinal surface 14 of which defines one side of an open slot 15.

The main body 10 is formed of two mirror-image halves which are secured together face-to-face by snap dowels or screws as indicated diagrammatically at 16. The two halves may also be glued or otherwise bonded together. The halves of the main body may conveniently be moulded from plastics material, but could equally well be of metal, wood or any other suitable material. In the case where the main body is formed from plastics, the two halves thereof may be bonded together by ultrasonic welding.

The facing surfaces of the two halves define an internal elongate slot 17 within the main body 10. The slot may be formed by a single recess in one half abutting a flat surface on the other half, or by similar registering recesses in both halves.

An elongate steel cutting blade 18 is slidable along the slot 17 within the main body and has a portion of its cutting edge 19 exposed across the slot 15 in a location which is spaced inwardly from the mouth 20 of the slot. Transverse dowel pins 21 support the edge of the sliding blade 18 opposite the exposed portion 19 of its cutting edge.

A helical tension spring 22 is located in one end of the internal slot 17, and one end of the spring is attached to a fixed part of the handle portion 12, as indicated at 23. The opposite end of the spring 22 is attached to a transverse pin 24 which passes through a hole in the end of the blade 18 and the ends of the pin project through longitudinal slots 25 in the sides of the main body 10. The projecting extremities of the pin 24 are engaged with a collar 26 which embraces the handle portion 12 and is slidable to and fro along the handle portion. The handle portion 12 and the interior surface of the collar 26 are non-circular in cross-section so that the collar cannot rotate on the handle. The portion of the slot 17 in which most of the blade 18 is slidable is flat-sided so as to guide the blade, whereas the opposite end of the slot, enclosing the tension spring 22, is circular in cross-section.

In use, for example to cut a length of sting tying up a parcel or bundle, the tapered tip portion 13 of the knife is introduced beneath the string and the knife is pushed forwardly so that the string slides along the surface 14 of the tapered tip portion and on to the exposed portion 19 of the cutting edge of the blade, and is thereby severed. If the user holds the handle portion 12 beyond the collar 26, the blade 18 remains stationary and the knife operates in the conventional manner of known safety knives. However, in order to enhance the cutting action, the user may, during the cutting action, slide the collar 26 towards the head 11, against the action of the spring 22, so as to slide the blade across the slot 15 towards the end of the tapered tip portion 13. This sliding movement of the cutting edge of the blade enhances its cutting effect on the string, making it easier to cut.

The user may slide the collar 26 forwards after the knife has been fully introduced under the string so as to perform the sliding cutting action when the string is wedged in the acute angle between the cutting edge and the part 27 of the head opposite the tapered tip portion 13. Alternatively. the user may push the collar 26 forwards at the same time as introducing the tapered tip portion beneath the string, so that the cutting edge 19 is sliding forwards longitudinally at the same time as the string passes along it into the slot. To enhance the latter action, the collar 26 may be extended, as indicated in chain lines at 28, so as to extend along the major portion of the handle part 12. The user will then grip the extended collar 28, rather than the handle part 12, when using the knife, and the collar will then automatically move forwards relative to the main body 10 as a result of the restraint provided by the string to forward movement of the head 11. The sliding cutting action of the blade will therefore be performed automatically each time the knife is used. The collar slides forwards to the position shown in dotted lines at 26*a* in FIG. 1, the movement of the collar being limited by movement of the ends of the pin 24 in the slots 25.

The knife may be used in similar fashion to cut adhesive tape, flat binding strips or sheet material.

Figure 2:
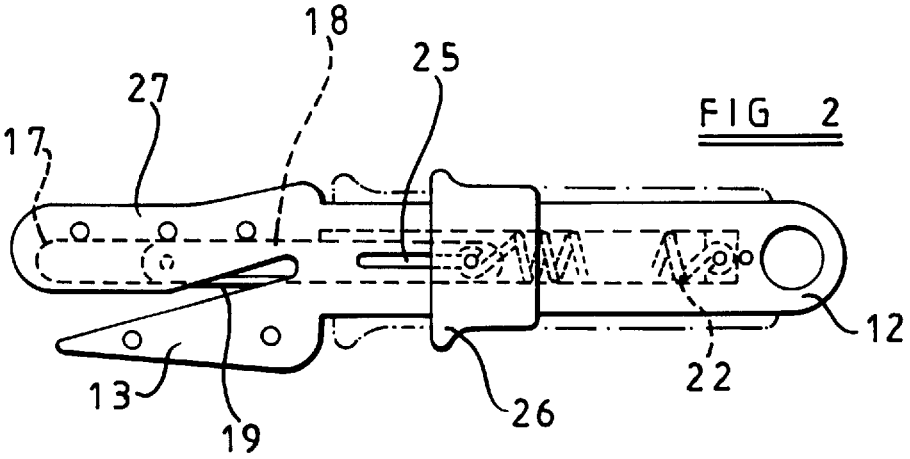
FIGS. 2–5 are similar views of alternative versions of the invention.

FIG. 2 shows a modification of the knife shown in FIG. 1 and corresponding parts have the same reference numerals. In the FIG. 2 arrangement the head 10 is differently shaped so that the exposed cutting edge 19 of the blade extends at an acute angle to the tapered tip portion 13, instead of at an obtuse angle. Consequently, as the string or other material is introduced into the slot 15 it wedges into the acute angle between the blade and the longitudinal surface 14 of the tapered tip portion before being cut. Again, the blade 18 can be slid forwards, either automatically or at the selection of the user, to enhance the cutting action.

In either of the arrangements of FIGS. 1 and 2 the surface of the head portion 11 with which the cutting edge of the blade makes an acute angle may be provided with a shaped groove into which the cutting edge of the blade passes, as described in British Patent No. 2216835. This may improve the ease with which material is cut by the knives since the folding of the material across the cutting edge as it is pushed partly into the groove during the cutting action increases the pressure with which the material presses on the cutting edge. However, such feature is not essential to the present invention.

In either of the arrangements of FIGS. 1 and 2 the tension spring 22, which returns the sliding blade to its datum position, may be replaced by a compression spring. Various arrangements are possible. For example, the compression spring may be disposed between the left hand extremity of the sliding blade 18 and the end of the slot 17. Alternatively, the compression spring may be disposed at the right hand end of the slot 17 in which case it may encircle an end portion of the blade, or an extension thereof the left hand end of the compression spring abutting a fixed part of the handle portion 12 and the right hand end of the compression spring being attached to the right hand end of the blade or extension thereof. Alternatively, the compression spring may lie alongside the blade in a deepened portion of the slot in which the blade is received.

Figure 3:
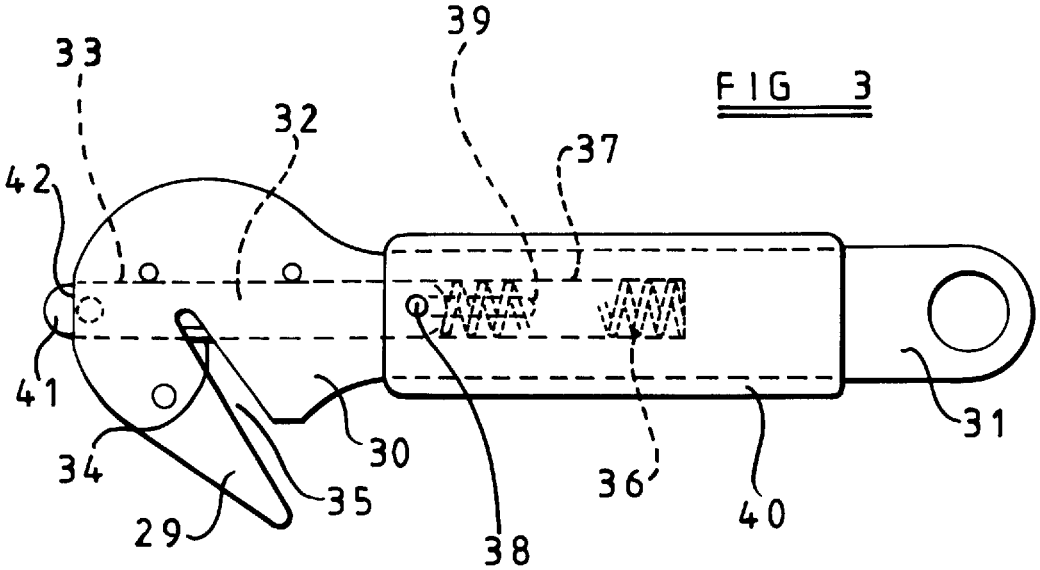

FIG. 3 shows another modified version of the knife, this time for performing a cutting action when being pulled towards the user. Such action may sometimes be preferred for cutting tapes or strings or for ripping open wrappings.

In this case the tapered tip portion 29 of the head 30 is inclined backwardly towards the handle part 31. The blade 32 is again sidable in a slot 33 within the main body of the knife and has an exposed portion 34 of its cutting edge extending across the slot 35 in the head 30. The cutting edge 34 extends at an acute angle to the inner surface of the tip portion 29.

In this case, however, the blade 32 is urged to the left by a compression spring 36 which is located within a cylindrical extension 37 of the slot 33. One end of the compression spring 36 abuts the end of the extension 37 and the opposite end abuts a transverse pin 38 which extends through a hole in the blade 32 and opposite ends of which project through slots 39 in the handle portion 31 to engage a sleeve 40 which is slidable on the handle portion 31.

In use, the user grips the knife by the sleeve 40, introduces the tapered tip portion 29 beneath the string or other material to be cut and draws the knife towards himself. The pulling action causes the sleeve 40 to slide along the handle portion 31, to the right in FIG. 3, thus causing the blade 32 to slide across the slot 35 and thereby enhance the cutting action.

One extremity of the blade 32 is formed with a small part-circular projection 41 which projects beyond a flattened portion 42 of the head 30 when the blade 32 is held in the datum position by the compression spring 36. The projection 41 may be used for slitting wrapping materials or sealing tape on boxes by pressing the head of the knife downwards so that the projection 41 pierces the tape or wrapping whereupon the tape or wrapping may be slit by drawing the knife towards the user. Since the head of the knife is pressed down on the material to be cut, the blade 32 does not move during such action. Preferably the projection 41 does not have a sharp cutting edge for safety reasons. A projecting slitting portion, corresponding to the portion 41, may also be provided on the blade in the versions of the knife shown in FIGS. 1 and 2.

In a modified version, the cutting edge of the blade 32 may be disposed at an obtuse angle to the inner surface of the tip portion 29. In this case the blade will extend through the head 30 at approximately 90° to the handle 31, and may be slid longitudinally downwards by pressing a spring-loaded plunger projecting upwards from the upper edge of the head 30, opposite the slot 35.

Figure 4:
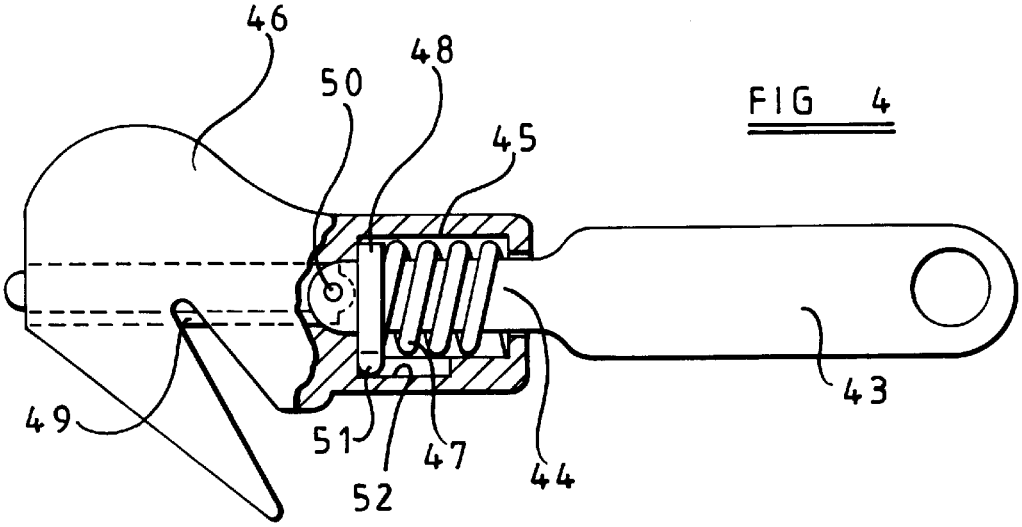

FIG. 4 shows a modified version of a knife of the type shown in FIG. 3 where the sliding sleeve is replaced by a solid handle 43 having a neck portion 44 which is received in a chamber 45 formed on the head 46 of the knife. A compression spring 47 encircles the neck 44 between one end of the chamber 45 and a flange 48 on the end of the handle 43. The handle 43 is connected to the blade 49 by a transverse pin 50.

A projection 51 on the flange 48 slides along an axial groove 52 in the wall of the chamber 45 to prevent relative rotation between the handle 43 and the head 46. Alternatively the neck 44, flange 48 and chamber 45 may be noncircular in cross-section so as to prevent such relative rotation.

In use, the user grips the handle 43 and in drawing the knife towards himself the spring 47 is compressed and the blade 49 slides across the slot into which the material to be cut is introduced. The groove 52 stops short of the right hand end wall of the chamber 45 to prevent there being sufficient movement to crush the spring 47.

In the arrangements described above the main body of the knife is preferably formed in two halves bonded, clipped, riveted or screwed together, with the blade and spring received in internal recesses between the two halves. However, this is not essential to the invention, and the head and handle may be fonned in one piece. In this case the blade may be slid longitudinally into the end of an elongate passage formed in the main body, or may be received sideways in a recess in the outer surface of the body. The spring may be inserted laterally into an elongate slot which passes wholly or partly through the body, being retained in the slot by the surrounding sliding collar or sleeve.

Figure 5:
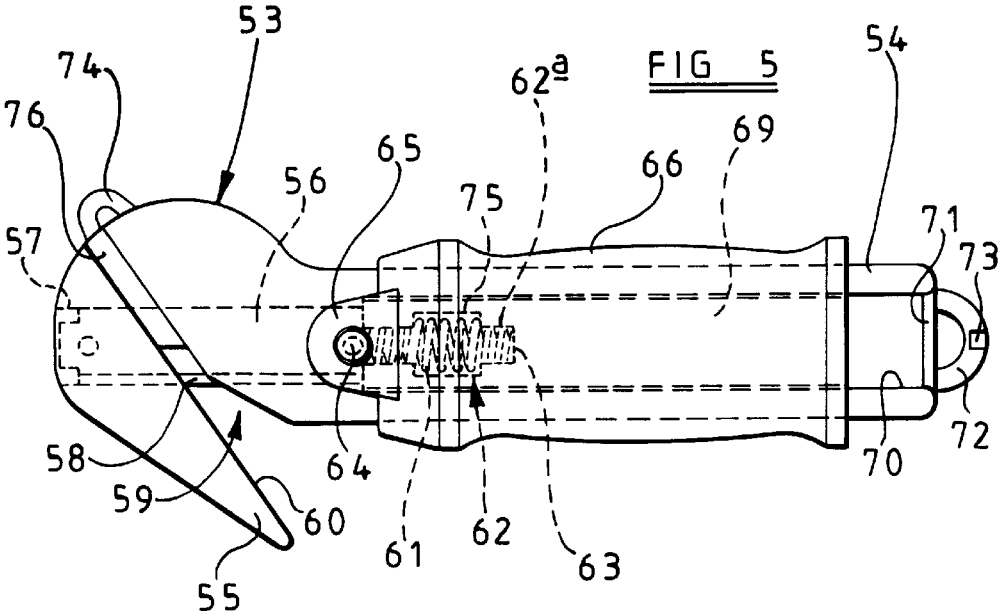
Figure 6:
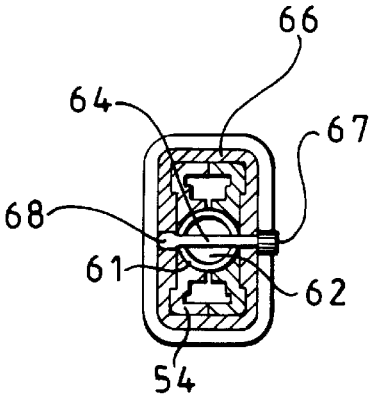
FIG. 6 is a cross-section through the knife of FIG. 5.

FIGS. 5 and 6 show a preferred form of safety knife in accordance with the invention which is a development of the knife shown in FIG. 3, and is generally similar in operation.

The main body of the knife comprises a head part 53 which is integral with a handle part 54. A tapered tip portion 55 of the head part 53 is inclined backwardly towards the handle part 54. A blade 56 is slidable in a slot 57 within the main body of the knife and has an exposed portion 58 of its cutting edge extending across a slot 59 in the head 53. The cutting edge 58 extends at an acute angle to the inner surface 60 of the tip portion 55.

The blade 56 is urged to the left by a helical compression spring 61 which is located within a cylindrical cavity 62 forming an extension of the slot 57. One end of the compression spring 61 abuts the end 63 of the cavity 62 and the opposite end abuts a transverse metal pin 64 which extends through a hole in the blade 56.

Opposite ends of the pin 64, outside the handle 54, pass through holes in parallel lugs 65 formed at one end of an elongate sleeve 66 which is slidable on the handle portion 54. The pin 64 is formed with an enlarged knurled head 67 by which the pin may be manipulated. The opposite end of the pin 64 is also slightly enlarged in diameter, as indicated at 68. The size of the aperture in the lug 65 adjacent the head 67 of the pin is such that considerable pressure is required to force the enlarged end 68 of the pin through it, whereas the enlarged end 68 enters the aperture in the opposite lug more easily, although it is still frictionally restrained thereby. This arrangement means that when the pin 64 is withdrawn to change the blade 56, the enlarged end 68 of the pin cannot easily slip through the aperture in the lug 65 adjacent the head 67, so that the pin is retained on the sleeve 66 and will not be lost.

In addition to the frictional engagement between the end 68 of the pin 64 and the lug 65, the force exerted on the pin 64 by the compression spring 61 also serves to retain the pin in position.

The opposite internal surfaces of the sleeve 66 are formed with longitudinal projections 69 which engage in, and are slidable along, shallow recesses 70 formed in the lateral surfaces of the handle portion 54. Movement of the sleeve 66 to the left in FIG. 5 is limited by engagement of the pin 64 with the end of the cavity 62 and by the engagement of the lugs 65 with correspondingly shaped end surfaces of the shallow recesses 70. Movement of the sleeve 66 to the right in FIG. 5 is limited by engagement of the end of the sleeve with an upstanding ridge 71 on one side of the end of the handle portion 54. Both the main body of the knife and the sleeve 66 are moulded from plastics material and the resilience of the sleeve 66 is sufficient to enable it to distort slightly and be snapped over the ridge 71 when it is first fitted over the handle portion 54. The main body may be moulded from Nylon 66 and the sleeve may be moulded from ABS.

A loop 72 is integrally moulded on the end of the handle portion 54 for attachment of the knife to a belt loop, lanyard or the like. The loop 72 has a bevelled portion 73 to facilitate engagement by a belt loop, split ring or the like.

As in the previously described arrangements, the main body of the knife may be formed from two mirror-image plastics mouldings which are secured together face to face, for example being bonded by ultrasonic welding. The slot 57 in which the blade 56 is slidable, and the cavity 62 which receives the spring 61, may be formed in only one of the two halves of the main body or may be formed partly in one half and partly in the other half.

Along the spring cavity 62, each half of the main body is formed with an elongate aperture 62*a* along which the pin 64 passes as the sleeve 66 is drawn to the right as viewed in FIG. 5. The spring may be positioned in the cavity 62 at the same time as the two halves of the main body are bonded together. However, the elongate aperture 62*a* in one half of the main body may also be of sufficient width to permit the insertion of the spring 61 laterally through the aperture into the slot extension after the two halves of the main body have been bonded together. The spring is then retained in the slot extension by the sleeve 66. Aiternatively and preferably, however, as shown in FIG. 5, the width of the elongate aperture 62*a* is less than the diameter of the spring 61 at its ends but has a central portion 75 of greater width. During assembly of the knife, therefore, the spring 61 may be fed into the cavity 62 through the enlarged portion 75 of the aperture, being compressed to enable this to be achieved, whereafter the spring expands into the cavity and is retained by the narrower end portions of the aperture.

Knives for different purposes may require springs of different compressive strengths. For example, a knife for cutting cling film will require a weaker compression spring than a knife for cutting cardboard. Typically the strength of the spring may be 6 lb, 3 lb or 1.5 lb. The last mentioned arrangement facilitates the manufacture of knives of different spring strengths since the spring does not have to be incorporated when the two halves of the main body are bonded together, but may be inserted at any time subsequently.

As before, in use the user grips the knife by the sleeve 66, introduces the tapered tip portion 55 beneath the material to be cut and draws the knife towards himself. The pulling action causes the sleeve 66 to slide along the handle portion 54, to the right in FIG. 5, thus causing the blade 56 to slide across the slot 59 and thereby enhance the cutting action. The head portion 53 of the knife is formed on each side with a shallow narrow groove 76 which forms a continuation of the slot 59 so that the cut edges of the material being cut pass along the grooves 76. The grooves 76 increase gradually in depth towards the cutting edge 58 of the blade so as to provide a smooth transition for the cut edges as they pass from the cutting edge 58 and in to the grooves 76.

When it is wished to replace the blade 56, the pin 64 is withdrawn and the sleeve 66 moved to the right, as viewed in FIG. 5, to expose the end of the blade. An implement may then be engaged in the hole in the end of the blade to move the blade to the left so that its opposite end projects through the opening at the end of the slot 57 so that the blade may be withdrawn and replaced by a new one. However, in some cases it may not be required that the blade should be replaceable, for example for safety reasons, and in that case the pin 64 may be permanently retained in position. For example, the end of the pin opposite the head 67 may project beyond the surface of the lug 65 and may then be deformed so that the pin cannot be withdrawn.

It will be seen that, in this version of the knife, the end of the blade 56 is cut square and does not project from the opening in the head of the knife as in the arrangement of FIG. 3 to provide a slitting cutter. Instead, such a cutter is separately and fixedly mounted on the head 53 as indicated at 74. The slitter 74, which is not sufficiently sharp to cause injury to a person handling the knife, may be formed from plastics and integrally moulded with the main body of the knife. Alternatively and preferably, however, the slitter 74 is a separate element formed from metal, such as stainless steel, or plastics, such as Nylon 66, and is fixedly secured within the main body of the knife so as to project from the head 53 a short distance as shown. For example, a portion ofthe slitter which is disposed within the head of the knife may be formed with apertures which are engaged by integrally moulded stepped dowels formed on one half of the main body.

Although the particular knives illustrated above all incorporate a spring to return the blade to a datum position, this is not essential to the invention and embodiments are possible in which the spring is omitted. In this case the blade is moved manually in both directions. Arrangements are also possible where the sliding movement of the blade is used solely to bring different portions of the cutting edge of the blade into the exposed position within the slot, without the sliding movement necessarily being used during the cutting action itself. In this case a spring is also not necessary and the blade may be slid to a required longitudinal position by the user, so as to ensure that a sharp portion of the cutting edge is exposed for use. In this case some form of movable detent device is preferably provided to retain the sliding blade temporarily in each of a number of different longitudinal positions, movement between such positions exposing a new portion of the cutting edge for use. For example there may be provided a ratchet-type mechanism between the main body of the knife and the collar or other device which controls movement of the blade.

I claim:

1. A knife comprising a main body formed with a slot having a narrow open mouth and a blade mounted on the main body with a portion of the cutting edge of the blade extending across the slot at a location spaced inwardly from the mouth of the slot, said blade being mounted on the main body for movement relative thereto across the slot, and a sleeve surrounding an elongate portion of the main body and coupled to the blade so that movement of the sleeve relative to the main body causes movement of the blade across the slot.

2. A knife comprising a main body formed with a slot having a narrow open mouth and a blade mounted on the main body with a portion of the cutting edge of the blade extending across the slot at a location spaced inwardly from the mouth of the slot, said blade being slidable along an elongate recess in the main body for movement relative thereto across the slot, means being provided to effect said movement of the blade, and spring means being located in a cavity forming an extension of said recess and being connected between one end of the blade and a fixed part of the main body so as to urge the blade to a datum position.

3. A knife according to claim 2, wherein the cavity containing the spring means is at least partly open to at least one longitudinal side of the main body so that the spring means may be inserted laterally into the cavity.

4. A knife comprising a main body formed with a slot having a narrow open mouth and a blade mounted on the main body with a portion of the cutting edge of the blade extending across the slot at a location spaced inwardly from the mouth of the slot, said blade being mounted on the main body for movement relative thereto across the slot, and a manipulating member movably mounted on the main body and coupled to the blade so that movement of the manipulating member relative to the main body causes movement of the blade across the slot, said manipulating member being in the form of a handle by which the knife may be held in use when cutting.

5. A knife according to claim 4, wherein the blade is enclosed within the main body save for the portion thereof which extends across the slot.

6. A knife according to claim 4, wherein the handle is mounted on the main body for sliding movement relative thereto in a direction substantially parallel to the cutting edge of the blade.

7. A knife according to claim 6, wherein the blade is directly coupled to the handle so that the blade moves in the same direction as the handle.

8. A knife according to claim 6, wherein stop means are provided to limit the movement of the handle relative to the main body.

9. A knife according to claim 4, wherein spring means are provided to urge the blade to a datum position.

10. A knife according to claim 9, wherein the blade is slidable along an elongate recess in the main body, said spring means being connected between one end of the blade and a fixed part of the main body.

11. A knife according to claim 10, wherein the spring means is located in a cavity forming an extension of said recess.

12. A knife according to claim 11, wherein the cavity containing the spring means is at least partly open to at least one longitudinal side of the main body so that the spring means may be inserted laterally into the cavity.

13. A knife according to claim 10, wherein the recess in which the blade is slidable extends from an opening at the surface of the main body so that the blade may be inserted into the recess, or removed therefrom, through said opening.

14. A knife according to claim 13, wherein the blade is movable to a position where a small portion thereof projects from said opening in the external surface of the main body.

15. A knife according to claim 4, wherein a separate projecting portion, for slitting, is fixedly provided on the main body of the knife.

16. A knife according to claim 4, wherein one side of the slot in the main body is defined by a longitudinal surface of a tapered tip portion of the main body, the exposed portion of the cutting edge of the blade extending at an obtuse angle to said longitudinal surface of the tapered tip portion so that, in use, the tapered tip portion may be introduced below the material to be cut so that the material slides up the longitudinal surface thereof and then directly on to the exposed cutting edge of the blade.

17. A knife according to claim 16, wherein the exposed portion of the cutting edge of the blade extends at an acute angle to the longitudinal surface of the tapered tip portion so that, in use, the material to be cut slides up the surface of the tapered tip portion and enters the acute angle between the blade and that surface with a wedging action, leading to the severing of the material.

* * * * *